US009175883B2

(12) United States Patent
Koberstein et al.

(10) Patent No.: US 9,175,883 B2
(45) Date of Patent: Nov. 3, 2015

(54) INTERNAL HEAT EXCHANGER WITH INTEGRATED RECEIVER/DRYER AND THERMAL EXPANSION VALVE

(71) Applicant: Ford Global Technologies, LLC, Dearborn, MI (US)

(72) Inventors: Manfred Koberstein, Troy, MI (US); Mitali Chakrabarti, Canton, MI (US); Steven L. Lambert, Washington, MI (US); Stephen Patrick Lepper, Ann Arbor, MI (US); Angelo Patti, Pleasant Ridge, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 225 days.

(21) Appl. No.: 13/924,670

(22) Filed: Jun. 24, 2013

(65) Prior Publication Data

US 2014/0373560 A1 Dec. 25, 2014

(51) Int. Cl.

| | |
|---|---|
| ***F25B 1/00*** | (2006.01) |
| ***F25B 40/00*** | (2006.01) |
| ***F28F 27/02*** | (2006.01) |
| *F25B 41/06* | (2006.01) |
| *F28D 21/00* | (2006.01) |

(52) U.S. Cl.

CPC ..... *F25B 1/005* (2013.01); *F25B 40/00* (2013.01); *F28F 27/02* (2013.01); *F25B 41/062* (2013.01); *F25B 2400/16* (2013.01); *F25B 2500/18* (2013.01); *F28D 2021/008* (2013.01); *F28D 2021/0068* (2013.01)

(58) Field of Classification Search

CPC ..... F25B 1/005; F25B 40/00; F25B 2400/16; F25B 41/062; F25B 2500/18

USPC ..... 62/115, 498, 503, 324.4, 174

See application file for complete search history.

(56) References Cited

U.S. PATENT DOCUMENTS

| | | | | |
|---|---|---|---|---|
| 3,552,140 | A * | 1/1971 | Palmer | 62/324.4 |
| 3,858,406 | A * | 1/1975 | Izumi | 62/210 |
| 3,938,349 | A * | 2/1976 | Ueno | 62/192 |
| 4,341,092 | A | 7/1982 | Davis | |
| 4,756,166 | A * | 7/1988 | Tomasov | 62/509 |
| 5,040,380 | A * | 8/1991 | Gregory | 62/225 |
| 5,396,776 | A * | 3/1995 | Kim | 62/115 |
| 5,799,499 | A * | 9/1998 | Yano et al. | 62/225 |
| 6,378,323 | B1 * | 4/2002 | Chavagnat | 62/324.4 |
| 7,654,109 | B2 * | 2/2010 | Vaisman et al. | 62/513 |
| 7,971,441 | B2 * | 7/2011 | Salim et al. | 62/115 |
| 2003/0010483 | A1 * | 1/2003 | Ikezaki et al. | 165/174 |
| 2003/0024267 | A1 * | 2/2003 | Zhang | 62/503 |
| 2008/0289805 | A1 * | 11/2008 | Filippi et al. | 165/167 |
| 2009/0205359 | A1 * | 8/2009 | Major et al. | 62/498 |

FOREIGN PATENT DOCUMENTS

WO 2006065186 A1 6/2006

* cited by examiner

*Primary Examiner* — Mohammad M Ali

(74) *Attorney, Agent, or Firm* — Vichit Chea; Brooks Kushman P.C.

(57) ABSTRACT

A HVAC system including a multi-function unit for conditioning and controlling the flow of refrigerant. The multi-function unit may be contained within a housing that houses a receiver/dryer, integral heat exchanger and thermal expansion valve.

9 Claims, 1 Drawing Sheet

INTERNAL HEAT EXCHANGER WITH INTEGRATED RECEIVER/DRYER AND THERMAL EXPANSION VALVE

TECHNICAL FIELD

This disclosure relates to heating ventilation and air conditioning (HVAC) systems for vehicles.

BACKGROUND

Improving energy efficiency is a growing concern with vehicles because of the need to improve fuel economy while assuring acceptable vehicle performance. The HVAC system in a vehicle uses a substantial amount of energy that impacts fuel efficiency.

An internal heat exchanger (IHX) may be included in a HVAC system to transfer heat from the hot liquid refrigerant passing from the condenser to the evaporator to the cool vapor refrigerant passing from the evaporator to the compressor. Including an internal heat exchanger in an HVAC system before the compressor may cause an additional concern because there is a potential for higher refrigerant temperature at the compressor inlet due to the heat added by the internal heat exchanger. Higher refrigerant temperature at the compressor inlet can have a negative impact on compressor durability.

A receiver/dryer may be included in HVAC systems to remove moisture and debris from the refrigerant after leaving the condenser. The receiver/dryer may also store refrigerant to assure the availability of liquid refrigerant for the thermal expansion valve.

A thermal expansion valve (TXV) may be included in HVAC systems to control the flow of refrigerant from the condenser to the evaporator based upon the temperature and pressure of the cool vapor refrigerant as it exits the evaporator.

Placing the IHX, TVX, and receiver/dryer components in the engine compartment of the vehicle may create potential issues with tube routing and leaking tube connections. Adding a receiver/dryer requires added space within the limited space available in the engine compartment The above problems and other problems are addressed by this disclosure as summarized below.

SUMMARY

This disclosure proposes integrating the receiver/dryer with the internal heat exchanger assembly allowing for simultaneous heat exchange between fluids and moisture/debris removal. A single housing may be provided for both the receiver/dryer and the internal heat exchanger assembly.

Internal heat exchangers are proposed to be incorporated in the refrigerant loop of the HVAC system. The internal heat exchanger allows for heat transfer from the hot liquid refrigerant entering the thermal expansion valve to the cool vapor exiting the evaporator and flowing to the compressor. This arrangement allows for a reduction in the liquid temperature and improved energy efficiency. Two common types of internal heat exchangers are co-axial tube and plate designs. The receiver/dryer is normally located in the refrigerant loop between the condenser and the internal heat exchanger.

By integrating the receiver/dryer into the internal heat exchanger assembly, liquid refrigerant enters into the receiver/dryer and passes through a filter and desiccant to remove debris and moisture. The liquid refrigerant from the receiver/dryer also passes through the first portion of the heat exchanger before entering the thermal expansion valve. The vapor exiting the evaporator passes through the second portion of the heat exchanger cooling the liquid. The integrated assembly reduces the number of lines to be connected and routed through the engine compartment of the vehicle and reduces the amount of space required to package the HVAC system. With the use of an internal heat exchanger, the evaporator performance is improved and lowers compressor power consumption.

In another embodiment, a thermal expansion valve may be attached to the internal heat exchanger with the integrated receiver/dryer. In this arrangement, the low pressure refrigerant that flows from the evaporator to the internal heat exchanger then flows through the heat and pressure sensing portion of the thermal expansion valve. The temperature of the refrigerant provided to the compressor inlet is controlled by the thermal expansion valve controlling the flow of refrigerant to the evaporator and reduces the potential for a negative impact on compressor durability.

According to one aspect of this disclosure, an integrated receiver/dryer and internal heat exchanger assembly is provided for a vehicle HVAC system that includes a compressor, a condenser, and an evaporator. The integrated receiver/dryer and internal heat exchanger assembly comprises a housing enclosing the receiver/dryer and the internal heat exchanger. A first inlet to the housing receives liquid refrigerant from the condenser. The liquid refrigerant flows through a filter and desiccant. The liquid refrigerant is supplied to a first portion of the heat exchanger and is subsequently supplied through a first outlet to the evaporator. A second inlet to the receiver/dryer in the housing receives gaseous refrigerant from the evaporator and supplies gaseous refrigerant to a second part of the heat exchanger. The gaseous refrigerant is subsequently supplied to the compressor. Heat is transferred from the liquid refrigerant to the gaseous refrigerant in the internal heat exchanger. The second portion of the refrigerant provided from the evaporator flows through the integrated heat exchanger to the compressor and then back to the condenser completing the refrigerant loop.

According to another aspect of this disclosure, a thermal expansion valve controls the flow of refrigerant to the evaporator based upon a temperature and a pressure of the gaseous refrigerant flowing from the internal heat exchanger to the compressor.

According to another aspect of this disclosure, wherein the thermal expansion valve is disposed in the housing.

According to another aspect of this disclosure, the first part of the heat exchanger and the second part of the heat exchanger provide independent flow paths through the heat exchanger.

According to another aspect of this disclosure, the first part of the heat exchanger and the second part of the heat exchanger are divided by a plurality of plates through which heat is transferred from the liquid refrigerant to the gaseous refrigerant in the internal heat exchanger.

According to another aspect of this disclosure, the first part of the heat exchanger and the second part of the heat exchanger are contained in coaxial tubes through which heat is transferred from the liquid refrigerant to the gaseous refrigerant in the internal heat exchanger.

According to another embodiment of this disclosure, a HVAC system is provided for a vehicle that includes a compressor, a condenser receiving refrigerant from the compressor and an evaporator receiving refrigerant from the thermal expansion valve. The system further includes a housing enclosing a combination of a receiver and a dryer that receives the refrigerant from the condenser and that flows through the dryer and is accumulated in the receiver. An internal heat exchanger is also disposed within the housing that transfers heat from the refrigerant flowing from the condenser to the evaporator to the refrigerant flowing from the evaporator to the compressor.

According to another aspect of this disclosure, the HVAC system may further comprise a thermal expansion valve disposed in the housing that controls the flow of refrigerant to the evaporator based upon a temperature and a pressure of the gaseous refrigerant flowing from the internal heat exchanger to the compressor.

According to another aspect of this disclosure the thermal expansion valve includes a sensing side and a valve side, and wherein gaseous refrigerant received from the evaporator flows through the sensing side and liquid refrigerant from the condenser flows through the valve side to the evaporator.

According to another aspect of this disclosure, the thermal expansion valve is calibrated to minimize superheating the gaseous refrigerant flowing from the evaporator by sensing the temperature of the refrigerant flowing to the compressor.

According to another aspect of this disclosure, the internal heat exchanger cools the refrigerant flowing from the condenser to the evaporator with the refrigerant from the evaporator to the compressor.

According to embodiment of this disclosure, a method of operating a vehicle HVAC system is disclosed that comprises compressing a refrigerant vapor in a compressor and providing the refrigerant vapor to a condenser. A refrigerant liquid and some refrigerant vapor are supplied from the condenser to a receiver/dryer that separates a gaseous phase portion of the refrigerant from a liquid phase portion of the refrigerant and that dries the refrigerant. The liquid refrigerant is supplied to a first side of an internal heat exchanger. Refrigerant liquid is supplied from the first side of the heat exchanger to an expansion valve that supplies a two phase mixture to an evaporator. Refrigerant vapor from the evaporator is supplied to a second side of the internal heat exchanger. The refrigerant liquid in the internal heat exchanger is cooled by the refrigerant vapor returning from the evaporator. The temperature and pressure of the refrigerant vapor flowing from the internal heat exchanger to the compressor is monitored to control the supply of the two phase mixture to the evaporator.

According to another aspect of this disclosure as it relates to the method, the step of monitoring the temperature and pressure of the refrigerant vapor may further comprise providing the refrigerant vapor to a thermal expansion valve after flowing through the internal heat exchanger to the compressor.

According to another aspect of this disclosure as it relates to the method, the thermal expansion valve may include a sensing side and a valve side. If so, the method may further comprise receiving the gaseous refrigerant from the evaporator that then flows through the internal heat exchanger, and from the internal heat exchanger to the sensing side of the thermal expansion valve. The liquid refrigerant from the internal heat exchanger flows through the valve side of the thermal expansion valve to the evaporator.

The above aspects of this disclosure and other aspects will be described in greater detail below with reference to the attached drawings.

DETAILED DESCRIPTION

A detailed description of the illustrated embodiments of the present invention is provided below. The disclosed embodiments are examples of the invention that may be embodied in various and alternative forms. The figures are not necessarily to scale. Some features may be exaggerated or minimized to show details of particular components. The specific structural and functional details disclosed in this application are not to be interpreted as limiting, but merely as a representative basis for teaching one skilled in the art how to practice the invention.

Figure 1:
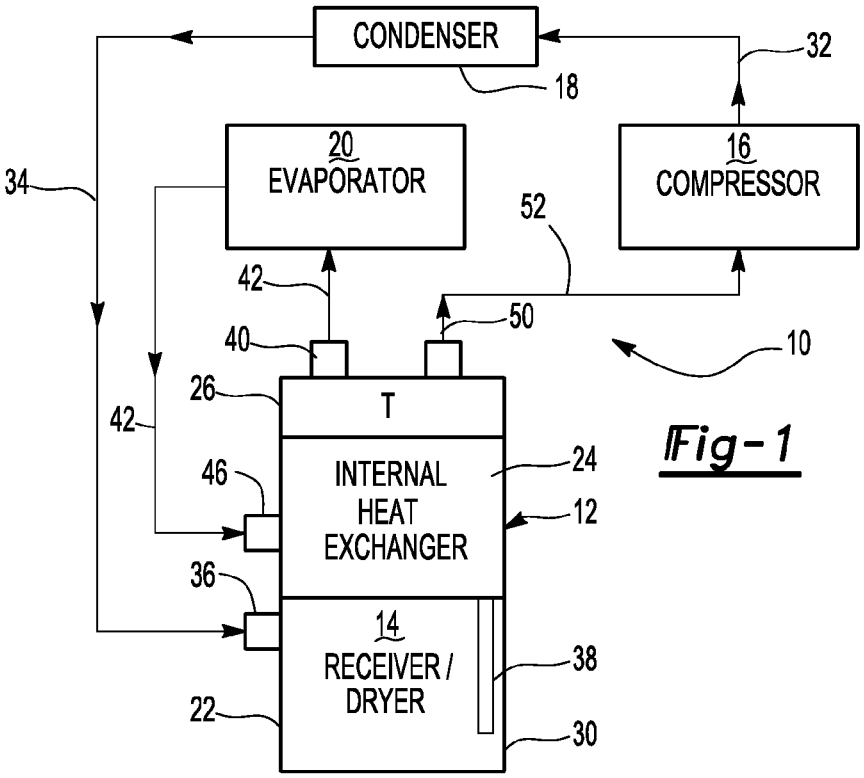
FIG. 1 is a diagrammatic illustration of one embodiment of an HVAC system including a multi-function unit for controlling and conditioning refrigerant flowing through the HVAC system.

Referring to FIG. 1, a heating ventilation and air conditioning (HVAC) system 10 is shown that includes a multi-function unit 12 for conditioning and controlling refrigerant 14 circulating through the system 10.

The HVAC system 10 includes a compressor 16 that compresses refrigerant 14 supplied to a condenser 18. The condenser 18 condenses the hot refrigerant vapor received from the compressor 16. The condenser 18 provides cooled liquid refrigerant to an evaporator 20 after passing through the multi-function unit 12. The evaporator 20 provides cool air to a passenger compartment (not shown) of a vehicle. Refrigerant 14 from the evaporator 20 is again circulated through the multi-function unit 12 and returned to the compressor 16.

Figure 2:
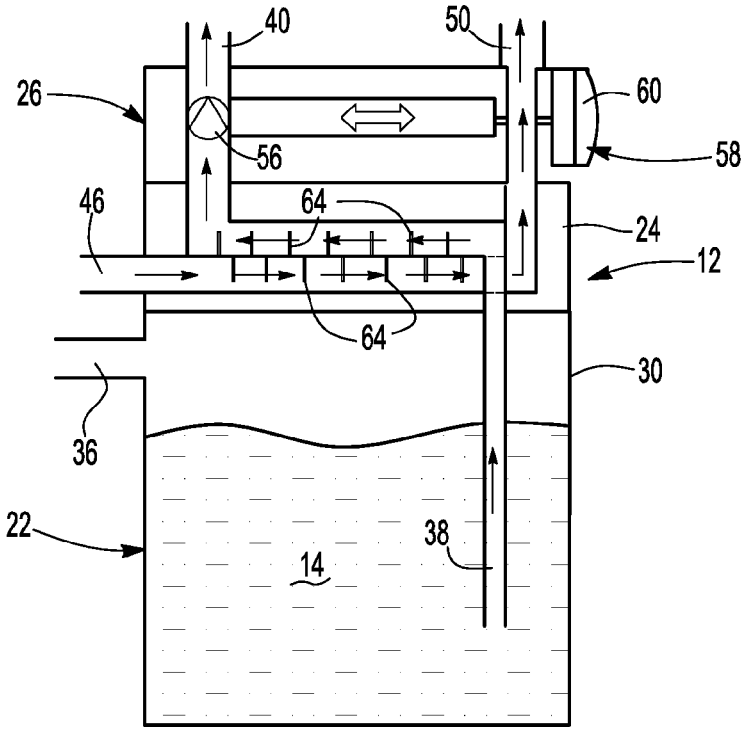
FIG. 2 is a schematic view of one embodiment of the multi-function unit.

Referring to FIGS. 1 and 2, the multi-function unit 12 includes a receiver/dryer 22 that receives refrigerant from the condenser. The receiver/dryer 22 includes a desiccant for drying the refrigerant and a fluid reservoir in which liquid refrigerant is collected after drying. Refrigerant 14 from the receiver/dryer 22 is routed through an integral heat exchanger 24 to a thermal expansion valve 26 before being supplied to the evaporator 20. The evaporator 20 provides refrigerant primarily in vapor form to the integral heat exchanger 24. The refrigerant flowing from the condenser 18 through the receiver/dryer 22 is cooled by the refrigerant vapor provided from the evaporator 20 through the receiver/dryer 22 before the refrigerant vapor is provided to the compressor 16. A housing 30 encloses the receiver/dryer, the integral internal heat exchanger 24, and the thermal expansion valve 26 to reduce the space required and simplifies assembly of the HVAC system into a vehicle. Providing a single housing for all three components also reduces the amount of tubing and the number of connectors required by the system.

Flow of the refrigerant through the system is described beginning with the compressor 16. The compressor 16 provides hot refrigerant vapor through line 32 to the condenser 18. The condenser 18 is cooled by air passing from the front of the vehicle and through the engine compartment to cool the refrigerant that is provided on line 34 to an inlet 36 of the receiver/dryer 22. An outlet tube 38 collects the liquid refrigerant from the receiver/dryer and directs it through the integral internal heat exchanger 24 to a TXV outlet 40 that provides low pressure two-phase refrigerant on line 42 to the evaporator 20. The two-phase refrigerant is evaporated in the evaporator 20 as air is blown over the evaporator 20 to cool the passenger compartment of the vehicle. After the refrigerant has passed through the evaporator 20, it is provided on line 44 to an IHX inlet 46 to the integral heat exchanger 24. The refrigerant received through the IHX inlet 46 cools the refrigerant flowing from the receiver/dryer 22 to the evaporator 20, as previously described. The refrigerant flows through the integral heat exchanger 24 from the IHX inlet 46 to the TXV and through a TXV outlet 50 through a line 52 to the compressor 16.

The TXV 26 includes a valve portion 56 that is opened and closed by the TXV to control the flow of refrigerant to the evaporator 20. The TXV also includes a sensing portion 58. Fluid flowing from the evaporator 20 through line 44 through the heat exchanger 24 passes through the sensing portion 58 where the temperature and pressure of the refrigerant 14 is ported through the TXV 26 near a dome 60 that is filled with a fluid. Expansion and contraction of the fluid within the dome 60 actuates the TXV 26 to open and close the valve portions 56 of the TXV 26.

In operation, the multi-function unit 12 performs a function of the receiver/dryer 22 by collecting the refrigerant 14 after being dried to remove moisture and debris. The receiver/dryer 22 provides refrigerant to the integral internal heat exchanger 24 that is used to cool the refrigerant flowing from the condenser 18 through the integral internal heat exchanger 24 and TXV 26 to the evaporator 20. Cooled refrigerant received from the internal heat exchanger 24 is expanded by TXV 26 improving the performance of the evaporator 20.

The TXV 26 measures the temperature and pressure to determine the extent of superheating of the refrigerant 14 provided to the compressor 16. If the superheat of the refrigerant provided to the compressor is too high, the TXV valve 26 increases the flow of refrigerant to the evaporator 20 by opening the valve portion 56 of the TXV 26. If the superheat of the refrigerant provided to the compressor 16 is low, the sensing portion 58 of the TXV 26 closes the valve portion 56 of the TXV to reduce the flow of refrigerant to the evaporator 20.

The preceding detailed description includes a thermal expansion valve as part of the multi-function unit 12. In a simpler embodiment the thermal expansion valve may be eliminated from the system 12. A stand-alone TXV (not shown) may be incorporated in the system 10 and the receiver/dryer and integral heat exchanger may be disposed in a single housing 30.

While exemplary embodiments are described above, it is not intended that these embodiments describe all possible forms of the disclosed apparatus and method. Rather, the words used in the specification are words of description rather than limitation, and it is understood that various changes may be made without departing from the spirit and scope of the disclosure as claimed. The features of various implementing embodiments may be combined to form further embodiments of the disclosed concepts.

What is claimed is:

1. A housing for a vehicle HVAC system comprising:
a receiver/dryer that receives refrigerant from a condenser,
a heat exchanger that transfers heat with the refrigerant flowing from the receiver/dryer via an outlet tube, and
a thermal expansion valve, mounted to the heat exchanger, that controls a flow of refrigerant to an evaporator and a compressor based upon a temperature and a pressure of a refrigerant flowing from the heat exchanger through the outlet tube.

2. The housing of claim 1 wherein a first part of the heat exchanger and a second part of the heat exchanger provide independent flow paths through the heat exchanger.

3. The housing of claim 2 wherein the first part of the heat exchanger and the second part of the heat exchanger are divided by a plurality of plates through which heat is transferred from refrigerant in a liquid state to refrigerant in a gaseous state in the heat exchanger.

4. The housing of claim 2 wherein the first part of the heat exchanger and the second part of the heat exchanger are contained in coaxial tubes through which heat is transferred from refrigerant in a liquid state to refrigerant in a gaseous state in the heat exchanger.

5. A HVAC system for a vehicle comprising:
a compressor;
a condenser that receives refrigerant from the compressor;
an evaporator that receives refrigerant from a thermal expansion valve; and
a housing enclosing:
a receiver/dryer that receives refrigerant from the condenser that flows through and is accumulated in the receiver/dryer,
a heat exchanger that transfers heat from refrigerant flowing from the condenser to refrigerant flowing from the evaporator, and
the thermal expansion valve that controls a refrigerant flow to the evaporator based upon a temperature and a pressure of refrigerant flowing from the heat exchanger to the compressor, wherein the thermal expansion valve is mounted to the heat exchanger and is fluidly connected to the heat exchanger and the receiver/dryer through an outlet tube.

6. The system of claim 5 wherein the thermal expansion valve includes a sensing side and a valve side, and wherein gaseous refrigerant received from the evaporator flows through the sensing side and liquid refrigerant from the condenser flows through the valve side to the evaporator.

7. The system of claim 6 wherein the thermal expansion valve is calibrated to minimize superheating the refrigerant in gaseous form flowing from the evaporator by sensing the temperature of the refrigerant flowing to the compressor.

8. The system of claim 5 wherein the heat exchanger cools refrigerant flowing from the condenser to the evaporator with refrigerant from the evaporator to the compressor.

9. A HVAC system for a vehicle comprising:
a housing enclosing,
a receiver/dryer that receives refrigerant from a condenser,
a heat exchanger that transfers heat with refrigerant flowing from the receiver/dryer via an outlet tube, and
a thermal expansion valve that controls a flow of refrigerant to an evaporator and a compressor based upon a temperature and a pressure of refrigerant flowing from the heat exchanger through the outlet tube.

* * * * *